US006053605A

United States Patent [19]

Sasaki

[11] Patent Number: 6,053,605

[45] Date of Patent: Apr. 25, 2000

[54] INK SUPPLY CONNECTION DEVICE FOR INK JET PRINTER

[75] Inventor: Toyonori Sasaki, Anjo, Japan

[73] Assignee: Brother Kogyo Kabushiki Kaisha, Nagoya, Japan

[21] Appl. No.: 08/982,336

[22] Filed: Dec. 2, 1997

[30] Foreign Application Priority Data

Mar. 18, 1997 [JP] Japan ..... 9-064864

[51] Int. Cl.[7] ..... B41J 2/175

[52] U.S. Cl. ..... 347/85

[58] Field of Search ..... 347/85, 86, 87; 277/603, 627, 630, 644, 649

[56] References Cited

U.S. PATENT DOCUMENTS 5,011,162 4/1991 Jelinek ..... 277/11
5,619,237 4/1997 Inoue et al. ..... 347/86

FOREIGN PATENT DOCUMENTS 6-238908 8/1994 Japan .
8-174862 7/1996 Japan .
8-174959 7/1996 Japan .

*Primary Examiner*—N. Le
*Assistant Examiner*—Michael Nghiem
*Attorney, Agent, or Firm*—Oliff & Berridge, PLC

[57] ABSTRACT

An ink supply connection device includes a protrusion joint having a protrusion on a head holder and a recess joint having a recess on an ink cartridge. When the cartridge is mounted on the head holder, the protrusion of the head holder fits into the recess of the cartridge, thereby retaining the cartridge so that the cartridge does not easily vibrate. A spring urges the cartridge toward a recording head so that the protrusion joint and the recess joint are closely coupled. The inhibition of vibration of the cartridge is enhanced and entrance of an air bubble through the junction between the protrusion joint and the recess joint is prevented.

21 Claims, 4 Drawing Sheets

INK SUPPLY CONNECTION DEVICE FOR INK JET PRINTER

BACKGROUND OF THE INVENTION

1. Field of Invention

The invention relates to an ink supply connection device for connecting an ink supply cartridge to a head holder which supports a recording head that ejects ink.

2. Description of Related Art

A conventional ink supply connection device (hereinafter, referred to as "connection device") is disclosed in Japanese Unexamined Patent Publication Nos. Hei 8-174959 and 8-174862 and is shown in FIGS. 4A and 4B. FIGS. 4A and 4B show a conventional ink cartridge 42, and a conventional head holder 46, to which a recording head 44 is fixed. The head holder 46 has an ink supply connection member 48. The ink cartridge 42 (hereinafter referred to as "cartridge") includes an ink supply hole 50. When the cartridge 42 is connected to the head holder 46, the connection member 48 enters the ink supply hole 50 so that ink is supplied to the recording head 44 through the connection member 48.

The head holder 46 is fixed to a carriage (not shown). By moving the carriage, the recording head 44 is moved to a desired position relative to a recording medium. The recording head 44 then ejects ink to form an image on the recording medium such as, for example, a character or a graphical illustration.

As the carriage moves, the cartridge 42 and the head holder 46 are subject to forces which cause them to vibrate. In some circumstances, vibrations of the cartridge 42 form gaps between the connection member 48 and the ink supply hole 50. Air bubbles may enter through such gaps and be drawn into the recording head 44. If this happens, ink ejection may become unstable or impossible.

To prevent this from occurring, the cartridge 42 shown in FIGS. 4A and 4B is provided with a protrusion 52 formed on a rear surface that faces the recording head 44. The head holder 46 includes a recess 54 for receiving the protrusion 52. Furthermore, the cartridge 42 has a recess 56 on its bottom surface, and the head holder 46 has an engaging portion 58 corresponding to the recess 56. Vibration of the cartridge 42 in the head holder 46 is prevented by the engagement between the protrusion 52 and the recess 54 and between the recess 56 and the engaging portion 58.

However, since these engagement portions fit together relatively loosely so that the cartridge 42 can be easily removed from the head holder 46, the engagement portions are insufficient for eliminating play or rattle therebetween. Although various other mechanisms for preventing vibrations of the ink cartridge 42 have been proposed, such mechanisms are subject to problems including, for example, an increased number of component parts as well as being a resistance or an impediment to cartridge attachment and detachment.

SUMMARY OF THE INVENTION

Accordingly, it is an object of the invention to provide an ink supply connection device that prevents a cartridge from vibrating when a head holder is moved.

Another object of the invention is to make it possible to suppress vibrations of the cartridge in any direction.

Still another object of the invention is to provide an ink supply connection device providing tight coupling between connected members at a low cost.

A further object of the invention is to further improve the tightness of the coupling between the cartridge and the head holder.

According to the invention, an ink supply connection device for an ink jet printer is provided for supplying ink that is ejected from a cartridge, which is removably connected to both a head holder and a recording head supported by the head holder. The ink supply connection device includes a protrusion joint portion provided on one of the head holder and the cartridge and having a penetrating hole that provides a passage for a supply of ink from the cartridge. The protrusion joint portion also has a protrusion around the penetrating hole. A recess joint portion is provided on the other one of the head holder and the cartridge and includes a penetrating hole that provides a passage for a supply of ink from the cartridge. The recess joint portion has a recess that is formed around the penetrating hole so that when the recess joint portion is connected to the protrusion joint portion, with the penetrating hole of the recess joint portion communicating with the penetrating hole of the protrusion joint portion, the recess matingly fitting with the protrusion. An urging element is provided for urging the cartridge toward the head holder in the direction in which the protrusion joint portion and the recess joint portion are fitted together.

For illustration purposes, the invention will be explained assuming that the protrusion joint portion is provided on the head holder and the recess joint portion is provided on the cartridge. When the cartridge is connected to the head holder so that the penetrating hole of the recess joint portion communicates with the penetrating hole of the protrusion joint portion, the recess of the recess joint portion fits into the protrusion of the protrusion joint portion. As a result, the cartridge and the head holder are connected by the recess joint portion and the protrusion joint portion. The urging element urges the cartridge toward the head holder in the direction of the connection between the protrusion joint portion and the recess joint portion. Thereby, the engagement between the protrusion and the recess is maintained so that the cartridge does not easily vibrate relative to the head holder even when the head holder is moved.

Therefore, the ink supply connection device of the invention prevents air bubbles from entering through a connecting portion between the cartridge and the head holder when the head holder is moved. Further, since the structure of the ink supply connection device of the invention is simple and the number of structural elements is small, the ink supply connection device can be produced at a low cost.

Substantially the same advantages can be achieved if the protrusion joint portion is provided on the cartridge and the recess joint portion is provided on the head holder. The urging element may have a structure wherein a plate spring is provided in a front portion of the head holder so as to press a rear end surface of the cartridge set in the head holder toward the recording head. It should be understood that such an urging element provided remote from the connecting portion between the cartridge and the head holder is included as a component of the ink supply connection device of the invention.

Since forces that act on the cartridge are mainly caused when the carriage moves, the forces normally act in lateral directions. However, forces may act on the cartridge in a longitudinal or vertical direction. For example, when a printer equipped with the head holder is moved and placed, for example, onto a desk, the cartridge may experience forces in a longitudinal or vertical direction and, therefore, may vibrate in the longitudinal or vertical direction. To prevent the entrance of air bubbles despite such longitudinal vibrations, the ink supply connection device of the invention may further have a structure wherein the protrusion of the protrusion joint portion has an annular configuration surrounding the penetrating hole of the protrusion joint portion. With the annular configuration, the protrusion and the recess become engaged and preclude movement in any direction other than the direction of force of the urging element. As a result, vibrations are prevented not only in lateral directions but in any direction.

Although the urging element urges the cartridge toward the head holder, a gap may exist in the connecting portion and an air bubble may enter therethrough if the shape of the protrusion does not sufficiently conform to the recess. However, it is not economical to precisely form the shape of the protrusion joint portion and the recess joint portion so that they exactly correspond to one another.

To eliminate such a potential drawback, the ink supply connection device of the invention may further have a structure wherein at least one of the recess joint portion and the protrusion joint portion is formed of a deformable material, such that the joint portion or portions deform when experiencing a force from the urging device.

When experiencing an urging force from the urging element, at least one of the joint portions deforms so that the two joint portions become tightly and closely coupled. Since such tight coupling is accomplished by deformation of the joint portion, it is not required to form the shape of the protrusion joint portion and the recess joint portion so that they exactly correspond to one another. By using such a deformable material for the joint portion or portions, costs for the joint portions can be reduced. Further, since the cartridge, including the joint portion, is replaced when the ink in the cartridge runs out, the joint portion of the cartridge may be formed of an inexpensive hard synthetic resin to further reduce costs.

Either the protrusion joint portion or the recess joint portion may be formed of a harder material, as desired. It is also possible to form both joint portions of an appropriately deformable material. The ink supply connection device may further include a structure wherein a contact surface of the protrusion joint portion and a contact surface of the recess joint portion for contact therebetween are tapered surfaces. With such a tapered configuration, the protrusion enters the recess and is positioned such that the portions firmly contact each other, thereby achieving tight coupling. Since this engagement substantially suppresses movement not only in front-to-rear directions, but also in directions perpendicular to the tapered surfaces, the cartridge is firmly held in a condition such that vibrations of the cartridge are unlikely to occur. Thus, prevention of vibrations of the cartridge is further assured.

BRIEF DESCRIPTION OF THE DRAWINGS

These and other aspects and advantages of the invention will become apparent from the following detailed is description of preferred embodiments when taken in conjunction with the accompanying drawings, in which.

DETAILED DESCRIPTION OF PREFERRED EMBODIMENTS

Figure 1:
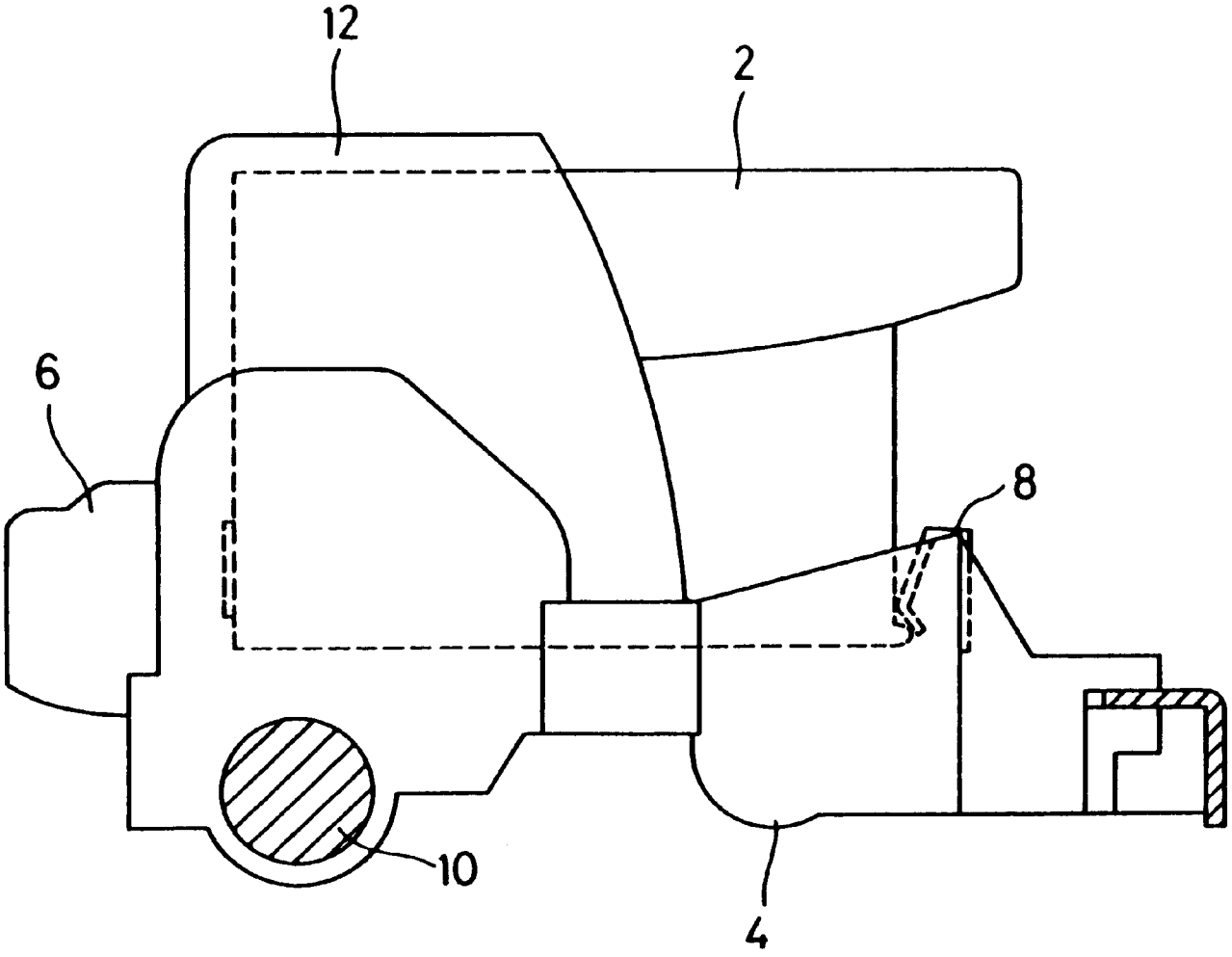
FIG. 1 is a side perspective view of an ink cartridge in accordance with an embodiment of the invention and shows the ink cartridge fitted to a carriage.

While the invention will hereinafter be described in connection with preferred embodiments thereof, it will be understood that it is not intended to limit the invention to those embodiments. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate like elements.

FIG. 1 is a side perspective view of an ink cartridge 2 mounted on a carriage 4. The carriage 4 carries a recording head 6 thereon. Ink is supplied from the ink cartridge 2 to the recording head 6. The recording head 6 ejects ink to the left as shown in FIG. 1. A spring 8 is a plate spring and forms an urging device. The spring 8 presses the cartridge 2 against the carriage 4 toward the recording head 6 (to the left in FIG. 1). The carriage 4 is movable along a guide shaft 10 to a desired location.

Figure 2:
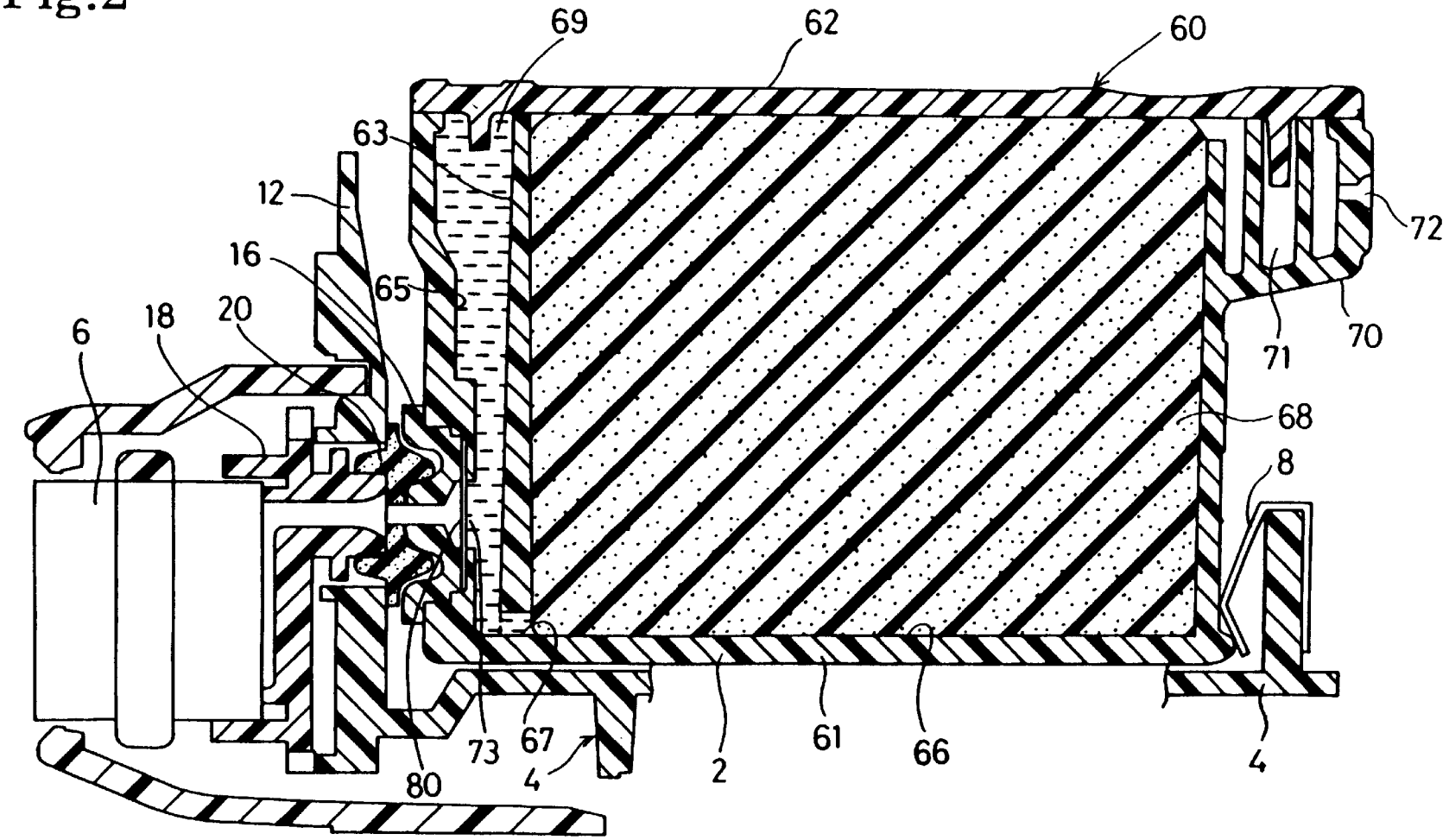
FIG. 2 is a sectional view of the ink cartridge and a head holder in accordance with an embodiment of the invention.

Referring to FIG. 2, the ink cartridge 2 has a cartridge case 60 including a case body 61 made of synthetic resin and having an opening at the upper end thereof. A lid 62 closes the upper end opening of the case body 61. The case body 61 includes a partition wall 63 extending unitarily from side walls of the case body 61. The partition wall 63 divides the interior of the cartridge case 60 into a rearward section and a forward section at a volume ratio of 1:8. The rearward section on the rear side of the partition wall 63 forms an ink chamber 65. The forward section on the front side of the partition wall 63 forms a foam chamber 66. The ink chamber 65 contains ink 69 and the foam chamber 66 contains a porous member 68 impregnated with the ink 69. The porous member 68 is formed of, for example, a sponge having uniform pores throughout, or of similar structure.

An ink passage 67 for communication between the ink chamber 65 and the foam chamber 66 is formed in a lower portion of the partition wall 63, substantially in the middle of the right-to-left dimension of the partition wall 63. Ink 69 can move back and forth through the ink passage 67 between the ink chamber 65 and the foam chamber 66. A forwardly-protruding grip portion 70 is formed in an upper front end portion of the cartridge case 60 with which the ink cartridge 2 is held when it is set in and detached from the head holder 12. The grip portion 70 has a maze-like air passage 71 and an atmosphere communicating hole 72 for communication between the foam chamber 66 and the atmosphere. The walls within the grip portion 70 include a recess (not shown) in the upper edge of the walls adjacent the lid 62. The recesses in the upper edge of the walls enable air to enter from the atmosphere communicating hole 72, flow through the air passage 71 and the recesses in the upper edge of the walls, and flow into the foam chamber 66. An ink supply hole 73 for supplying the ink 69 into a manifold 18 is formed in a wall of the ink chamber 65 facing the recording head 6. The ink supply hole 73 is provided with a filter 80.

Figure 3A:
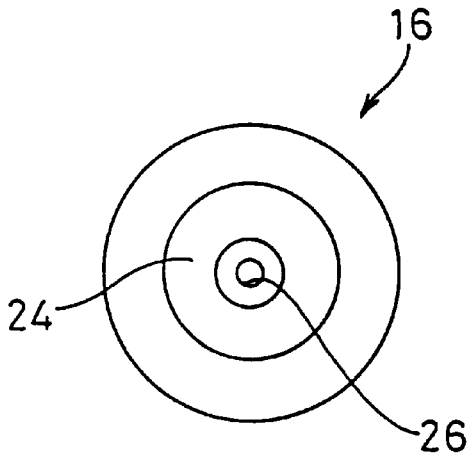
FIG. 3A is a rear view of the recess joint in accordance with an embodiment of the invention.
Figure 3B:
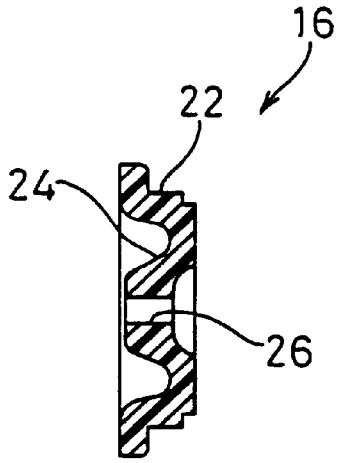
FIG. 3B is a sectional view of the recess joint in accordance with an embodiment of the invention.
Figure 3C:
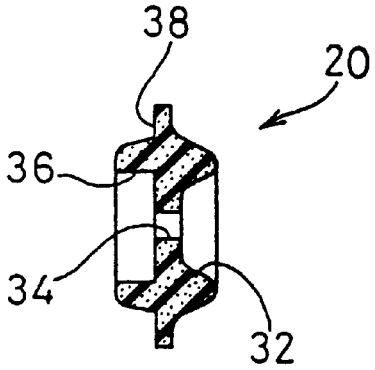
FIG. 3C is a sectional view of the protrusion joint in accordance with an embodiment of the invention.
Figure 3D:
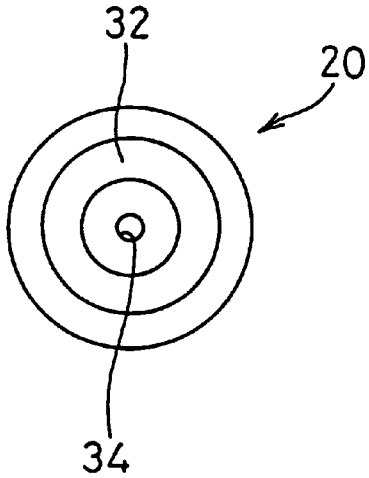
FIG. 3D is a front view of the protrusion joint in accordance with an embodiment of the invention.
Figure 4A:
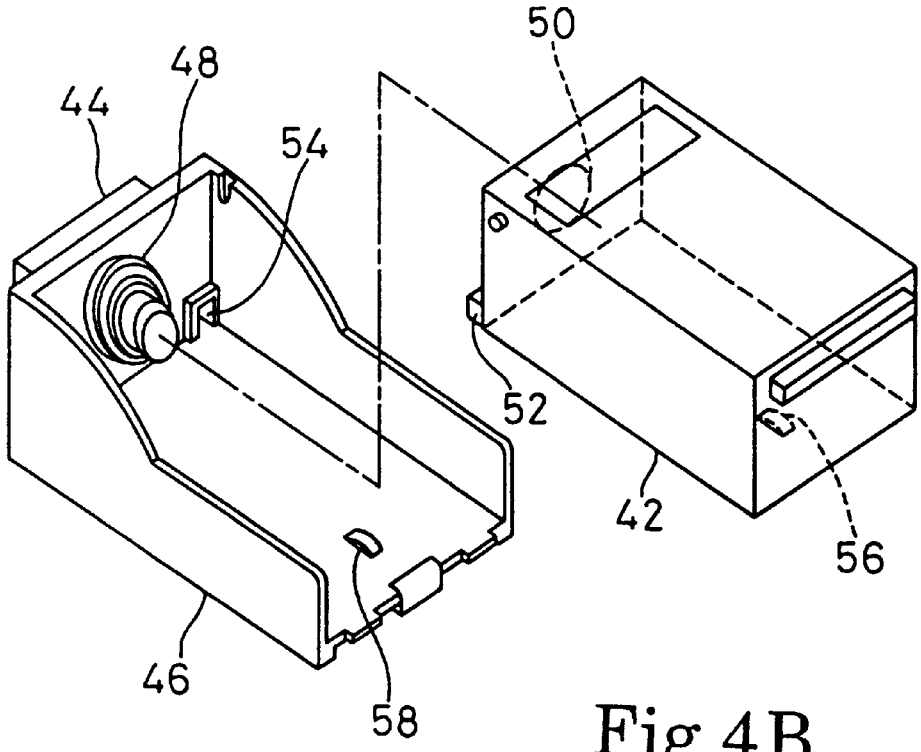
Fig.4A RELATED ART
FIG. 4A is a perspective view of a conventional ink cartridge mounted on a conventional head holder.
Figure 4B:
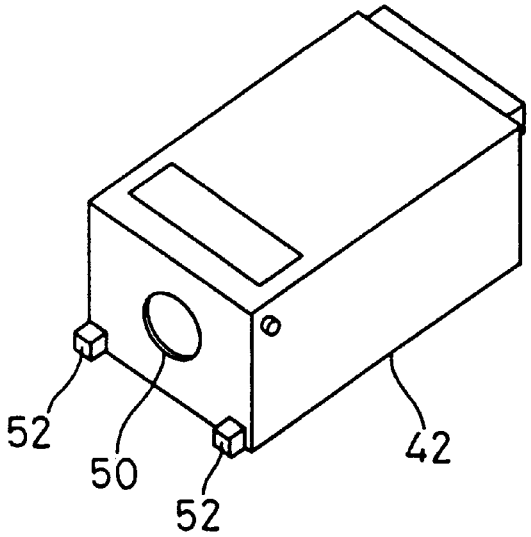
Fig.4B RELATED ART
FIG. 4B is a perspective view of the conventional cartridge shown in FIG. 4A.

A recess joint 16 is provided on a rear surface of the cartridge 2 (the surface on the side of the recording head 6)

as shown in FIG. 2. The manifold 18, forming an ink passage to the recording head 6, has a protrusion joint 20. The recess joint 16 and the protrusion joint 20 will be described with reference to FIGS. 3A to 3D. FIG. 3A is a rear view of the recess joint 16 viewed from the left in FIG. 2. FIG. 3B shows a sectional view of the recess joint 16. FIG. 3C shows a sectional view of the protrusion joint 20. FIG. 3D is a front view of the protrusion joint 20 viewed from the right in FIG. 2.

The recess joint 16 is a member having a circular shape as shown in FIG. 3A. Recess joint 16 is formed of a synthetic resin material that is harder than that of the protrusion joint 20. The recess joint 16 is fixed to the cartridge 2 by ultrasonic welding of an outer peripheral surface 22 of the recess joint 16. An annular recess 24 is formed on a side opposite the outer peripheral surface 22. A penetrating hole 26 for providing an ink supply passage is formed in a central portion of the recess joint 16. The recess 24 surrounds the penetrating hole 26. A surface of the recess 24 surrounding the penetrating hole 26 is a tapered surface.

The protrusion joint 20 also includes a circular shape as shown in FIG. 3D. An annular protrusion 32 is formed on a side of the protrusion joint 20. An inner peripheral surface of the annular protrusion 32 has a shape that is generally the same as the shape of the tapered surface of the recess 24 of the recess joint 16. A penetrating hole 34 for forming an ink supply passage is formed in a central portion of the protrusion joint 20. When the protrusion joint 20 is fixed at a fitting portion 36 formed thereon to the manifold 18, it becomes possible to supply ink to the manifold 18 through the penetrating hole 34. When the protrusion joint 20 is fixed to the manifold 18, a collar-shaped contact portion 38 of the protrusion joint 20 contacts the head holder 12. The protrusion joint 20 is formed of an elastic material such as, for example, a rubber.

The protrusion joint 20 is fixed to the manifold 18 of the head holder 12. The recess joint 16 is fixed to the ink cartridge 2. When the cartridge 2 is mounted on the head holder 12, the protrusion 32 of the protrusion joint 20 fits into the recess 24 of the recess joint 16 as shown in FIGS. 1 and 2, thereby coupling the ink cartridge 2 and the manifold 18 without allowing a gap therebetween. In this coupled condition, the penetrating hole 26 of the recess joint 16 and the penetrating hole 34 of the protrusion joint 20 communicate with each other, thereby allowing ink to be supplied from the ink cartridge 2 to the recording head 6 through the manifold 18.

Accordingly, when the ink cartridge 2 is set into the head holder 12, the ink cartridge 2 does not easily vibrate since the protrusion 32 of the protrusion joint 20 fits into the recess 24 of the recess joint 16 as shown in FIG. 2. Further, since the spring 8, disposed on the carriage 4, urges the ink cartridge 2 toward the recording head 6, the rubber protrusion joint 20 deforms into the shape of the recess 24 of the recess joint 16. Thus, the tapered surface of the protrusion 32 closely contacts the tapered surface of the recess 24. Thus, the force of the spring 8 causes the protrusion joint 20 to deform so that the two joints 16, 20 are firmly and closely coupled. Since close coupling between the joints 16, 20 is accomplished by deformation of the joint, it is not necessary to precisely form the shape of the recess joint and the protrusion joint so that they exactly correspond to one another. Therefore, production costs can be minimized.

Since forces that act on the cartridge 2 are mainly caused by the movement of the carriage 4, the forces normally act in lateral directions (parallel to the guide shaft 10). However, forces may act on the cartridge 2 in a longitudinal or vertical direction (perpendicular to the guide shaft 10). For example, the cartridge 2 may receive forces in longitudinal or vertical directions and therefore vibrate in such directions while a printer equipped with the head holder 12 is being moved or when the printer is placed, for example, onto a desk. In the connection device according to this embodiment, however, the recess 24 and the protrusion 32 have annular shapes as shown in FIGS. 3A–3D. As a result, the recess and protrusion joints 16, 20 substantially prevent the ink cartridge 2 from vibrating not only in lateral directions along the guide shaft 10, but also in longitudinal or vertical directions, even if the ink cartridge 2 receives forces in such directions.

The ink cartridge 2 can be removed from the head holder 12 simply by moving the ink cartridge 2 forward against the force of the spring 8 until the recess 24 is released from the protrusion 32.

As understood from the above description and explanation, using the head holder 12 provided with the protrusion joint 20 and the spring 8 and the ink cartridge 2 provided with the recess joint 16 according to the preferred embodiment prevents the ink cartridge 2 from vibrating. As a result, a gap is prevented from forming in the connection portion between the head holder 12 and the ink cartridge 2. Therefore, the connection device of the preferred embodiment prevents an accident where an air bubble enters, for example, the cartridge 2 through a gap between the recess joint 16 and the protrusion joint 20 even when either the carriage 4 or the printer is moved.

In the ink cartridge 2 according to the preferred embodiment, an air bubble may drift from the porous member 68 in the foam chamber 66 into the ink chamber 65 through the ink passage 67. If this happens, the air bubble rises to an upper portion of the ink chamber 65. However, since the ink supply hole 73 is formed in a lower portion of a side wall of the ink chamber 65, the air bubble will not drift into the ink supply hole 73 even when an amount of ink 69 is being supplied from the ink chamber 65 to the recording head 6 through the ink supply hole 73 and the manifold 18.

However, in an ink cartridge in which a foam chamber is provided on an ink supply hole side, ink and a small volume of air are held in a mixed state in the porous member in the foam chamber. As a result, an air bubble, together with a flow of ink supply, may be drawn into the ink supply hole and then to the recording head 6. If an air bubble reaches the recording head, it may become impossible to apply a sufficiently great force to ink in an ink channel to perform ink jet printing using a piezoelectric element. As a result, ink jet operation may become unstable or impossible.

While the invention has been described with reference to a preferred embodiment, the invention is not limited to this embodiment but may be performed in various other manners. For example, in the above embodiment, the recess joint 16 is formed of a synthetic resin and the protrusion joint 20 is formed of a rubber. However, it is also possible to employ a rubber recess joint and a synthetic resin protrusion joint, thereby achieving substantially the same advantages.

Further, it is also possible to provide a protrusion joint on an ink cartridge and provide a recess joint on a head holder. If a protrusion of the protrusion joint and a recess of the recess joint are formed so as to closely fit to each other, the two joints will be closely coupled by the force of the spring 8, thereby preventing the cartridge from vibrating. Also, it is possible to provide a protrusion joint on an ink cartridge and provide a recess joint on a head holder. If a protrusion of the protrusion joint and a recess of the recess joint are formed so as to closely fit each other, the two joints will be closely coupled by the force of the spring 8, thereby preventing the cartridge from vibrating.

While the invention has been described in conjunction with specific embodiments thereof, it is evident that many alternatives, modifications and variations may be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An ink supply connection unit for an ink jet printer for supplying ink from a cartridge that is removably connectable to a head holder to a recording head that is supported by the head holder, the ink supply connection unit comprising:

a protrusion joint portion, provided at one of the head holder and the cartridge and defining a penetrating hole that provides a passage for ink to be supplied from the cartridge, the protrusion joint portion having a protrusion around the penetrating hole;

a recess joint portion provided at the other one of the head holder and the cartridge and defining a penetrating hole that provides a passage for ink to be supplied from the cartridge, the recess joint portion having a recess that is formed around the penetrating hole so that when the recess joint portion is connected to the protrusion joint portion, with the penetrating hole of the recess joint portion communicating with the penetrating hole of the protrusion joint portion, the protrusion fits into the recess; and an urging element that urges the cartridge toward the head holder in a direction of connection between the protrusion joint portion and the recess joint portion, wherein the connection between the protrusion joint portion and the recess joint portion enables vibration of the cartridge to be substantially minimized.

2. The ink supply connection unit according to claim 1, wherein the protrusion of the protrusion joint portion has an annular structure surrounding the penetrating hole of the protrusion joint portion.

3. The ink supply connection unit according to claim 1, wherein at least one of the recess joint portion and the protrusion joint portion is formed of a deformable material such that said at least one of the joint portions deforms when receiving a force from the urging element.

4. The ink supply connection unit according to claim 1, wherein a contact surface of the protrusion joint portion and a contact surface of the recess joint portion for contact therebetween are tapered surfaces.

5. The ink supply connection unit according to claim 1, wherein the recess of the recess joint portion has an annular structure surrounding the penetrating hole of the recess joint portion.

6. The ink supply connection unit according to claim 1, wherein said penetrating hole in said protrusion joint portion is positioned in a central location of said protrusion joint portion, and said penetrating hole in said recess joint portion is positioned in a central location of said recess joint portion.

7. An ink supply connection device for an ink jet printer for supplying ink from a cartridge that is removably connectable to a head holder to a recording head that is supported by the head holder, the ink supply connection device comprising:

protrusion joint portion for matingly engaging the cartridge to the head holder provided at one of the head holder and the cartridge and defining a penetrating hole that provides a passage for ink to be supplied from the cartridge, the protrusion joint portion means having a protrusion around the penetrating hole;

recess joint portion means for matingly engaging the cartridge to the head holder provided at the other one of the head holder and the cartridge and defining a penetrating hole that provides a passage for ink to be supplied from the cartridge, the recess joint portion means having a recess that is formed around the penetrating hole so that when the recess joint portion means is connected to the protrusion joint portion means with the penetrating hole of the recess joint portion means communicating with the penetrating hole of the protrusion joint portion means, the protrusion fits into the recess; and means for urging the cartridge toward the head holder in a direction of connection between the protrusion joint portion means and the recess joint portion means, wherein the connection between the protrusion joint portion means and the recess joint portion means enables vibration of the cartridge to be substantially minimized.

8. The ink supply connection device according to claim 7, wherein the protrusion of the protrusion joint portion means has an annular structure surrounding the penetrating hole of the protrusion joint portion means.

9. The ink supply connection device according to claim 7, wherein at least one of the recess joint portion means and the protrusion joint portion means is formed of a deformable material such that said at least one of the joint portion means deforms when receiving a force from the means for urging.

10. An ink supply connection device according to claim 7, wherein a contact surface of the protrusion joint portion means and a contact surface of the recess joint portion means for contact therebetween are tapered surfaces.

11. The ink supply connection device according to claim 7, wherein the recess of the recess joint portion means has an annular structure surrounding the penetrating hole of the recess joint portion means.

12. The ink supply connection device according to claim 7, wherein said penetrating hole in said protrusion joint portion means is positioned in a central location of said protrusion joint portion means, and said penetrating hole in said recess joint portion means is positioned in a central location of said recess joint portion means.

13. A method of removably connecting a cartridge to a head holder of an ink jet printer so that ink can be supplied from said cartridge to said head holder, said method comprising the steps of:

providing a protrusion joint portion on one of the head holder and the cartridge and having a penetrating hole that serves as a passage for an ink supply from the cartridge, the protrusion joint portion having a protrusion around the penetrating hole;

connecting a recess joint portion to said protrusion joint portion, said recess joint portion provided on the other one of the head holder and the cartridge and having a penetrating hole that serves as a passage for an ink supply from the cartridge, the recess joint portion having a recess that is formed around the penetrating hole so that when the recess joint portion is connected to the protrusion joint portion with the penetrating hole of the recess joint portion communicating with the penetrating hole of the protrusion joint portion, the protrusion fits into the recess; and urging the cartridge toward the head holder in a direction of connection between the protrusion joint portion and the recess joint portion, wherein the connection between the protrusion joint portion and the recess joint portion enables vibration of the cartridge to be substantially minimized.

14. The method of claim 13, wherein the protrusion of the protrusion joint portion has an annular structure surrounding the penetrating hole of the protrusion joint portion.

15. The method of claim 13, wherein at least one of the recess joint portion and the protrusion joint portion is formed of a deformable material such that said at least one of the joint portions deforms when urging the cartridge toward the head holder.

16. The method of claim 13, wherein a contact surface of the protrusion joint portion and a contact surface of the recess joint portion for contact therebetween are tapered surfaces.

17. The method of claim 13, wherein the recess of the recess joint portion has an annular structure surrounding the penetrating hole of the recess joint portion.

18. The method of claim 13, wherein said penetrating hole in said protrusion joint portion is positioned in a central location of said protrusion joint portion, and said penetrating hole in said recess joint portion is positioned in a central location of said recess joint portion.

19. The ink supply connection unit according to claim 1, wherein said ink supply connection unit connects said head holder to said cartridge, said cartridge includes an ink chamber holding ink and a foam chamber holding a porous member that can be impregnated with ink, said ink chamber having an ink supply hole communicating with at least one of the penetrating hole of the protrusion joint portion and the penetrating hole of the recess joint portion.

20. The ink supply connection device according to claim 7, wherein said ink supply connection device connects said head holder to said cartridge, said cartridge includes an ink chamber holding ink and a foam chamber holding a porous member that can be impregnated with ink, said ink chamber having an ink supply hole communicating with at least one of the penetrating hole of the protrusion joint portion means and the penetrating hole of the recess joint portion means.

21. The method of claim 13, wherein said cartridge includes an ink chamber holding ink and a foam chamber holding a porous member that can be impregnated with ink, said ink chamber having an ink supply hole communicating with at least one of the penetrating hole of the protrusion joint portion and the penetrating hole of the recess joint portion.

* * * * *